US006454575B1

(12) United States Patent
Jones et al.

(10) Patent No.: US 6,454,575 B1
(45) Date of Patent: Sep. 24, 2002

(54) POWER PLUG CONNECTOR HAVING PRESS-FIT CONTACTS

(75) Inventors: Dennis B. Jones, Orange, CA (US); Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/953,482

(22) Filed: Sep. 14, 2001

(51) Int. Cl.[7] ..... H01R 12/20
(52) U.S. Cl. ..... 439/79; 439/733.1; 439/573
(58) Field of Search ..... 439/79, 733.1, 439/573

(56) References Cited

U.S. PATENT DOCUMENTS 5,228,873 A * 7/1993 Hirai ..... 439/573
5,263,882 A * 11/1993 Peterson ..... 439/733.1
5,667,392 A * 9/1997 Kocher et al. ..... 439/733.1
6,171,126 B1 * 1/2001 Wu et al. ..... 439/733.1
6,275,389 B1 * 8/2001 Huang et al. ..... 439/573
6,293,823 B1 * 9/2001 Kasuga ..... 439/573

* cited by examiner

*Primary Examiner*—Gary F. Paumen
(74) *Attorney, Agent, or Firm*—Wei Te Chung

(57) ABSTRACT

A power plug connector (1) comprises a unitarily molded insulative housing (2) and a number of bottom-assembled contacts (3) retained in the housing. The housing defines a number of passageways (208) and a number of upwardly extending recesses (210) each communicating with a corresponding passageway. Each contact has a mating portion (30), a mounting portion (32) perpendicular to the mating portion and received in a corresponding passageway, and a retention portion (34) upwardly extending from the mounting portion. The retention portion is received in a corresponding recess and has a number of barbs (340) thereon.

1 Claim, 8 Drawing Sheets

POWER PLUG CONNECTOR HAVING PRESS-FIT CONTACTS

BACKGROUND OF THE INVENTION

1. Field of the Invention

The present invention relates to an electrical connector, and particularly to a power plug connector having press-fit contacts for being mounted on a printed circuit board of a server.

2. Description of Related Art

It is known that each server is equipped with a power plug connector for connecting with a complementary cable assembly which connects with a power supply system for supplying power to a printed circuit board on which the power plug connector is mounted. Referring to FIGS. 7 and 8, a related power plug connector comprises a two-piece insulative housing 8 consisting of an upper housing 80 and a lower housing 81 and a plurality of contacts 9 retained therein. The upper housing 80 defines a plurality of upper passageways 82 and the lower housing 81 defines a plurality of lower passageways 83 corresponding to the upper passageways 82. Each contact 9 includes a mating portion 90, a mounting portion 92 perpendicular to the mating portion 90, and a projection 94 formed at the junction of the mating portion 90 and the mounting portion 92. In assembly, the contacts 9 are first downwardly inserted into the lower passageways 83 of the lower housing 81. The upper housing 80 is then secured to the lower housing 81 with fasteners and the projections 94 of the contacts 9 are received in the upper passageways 82. Thus, the contacts 9 are retained in the housing 8.

However, securing the contacts 9 to the housing 8 in the above-mentioned manner is time-consuming. During the assembly process, the upper passageways 82 of the upper housing 80 must be accurately aligned with the lower passageways 83 of the lower housing 81. Since the upper housing 80 and the lower housing 81 are individually molded, the manufacturing is complicated, thereby increasing the manufacturing cost. Further, when the power plug connector is subject to vibration, the engagement between the upper housing 80 and the lower housing 81 is easy to become loose. This will cause the contacts 9 to be unreliably secured in the housing 8. As a result, an electrical engagement between the power plug connector and the cable assembly may be adversely affected.

Hence, an improved power plug connector having press-fit contacts secured in a unitarily molded housing thereof is required to overcome the disadvantages of the related art.

SUMMARY OF THE INVENTION

Accordingly, one object of the present invention is to provide a power plug connector having press-fit contacts reliably secured to an insulative housing thereof, thereby ensuring a reliable electrical engagement between the power plug connector and a complementary cable assembly.

Another object of the present invention is to provide a power plug connector having a unitarily molded insulative housing for stably retaining a plurality of contacts therein.

In order to achieve the objects set forth, a power plug connector in accordance with the present invention comprises a unitarily molded insulative housing and a plurality of press-fit contacts retained in the housing. The housing defines a receiving cavity in a mating face thereof, a plurality of passageways upwardly extending from a mounting face thereof and communicating with the receiving cavity, and a plurality of upwardly extending recesses each communicating with a corresponding passageway. The contacts are press-fit into the housing from the mounting face. Each contact includes a mating portion received in the receiving cavity, a mounting portion extending in a direction perpendicular to the mating portion and received in the corresponding passageway, and a retention portion upwardly extending from the mounting portion. The retention portion is received in a corresponding recess and has a plurality of barbs thereon for retaining the retention portion in the recess. Thus, the contact is reliably secured to the housing.

Other objects, advantages and novel features of the invention will become more apparent from the following detailed description when taken in conjunction with the accompanying drawings.

DETAILED DESCRIPTION OF THE INVENTION

Figure 1:
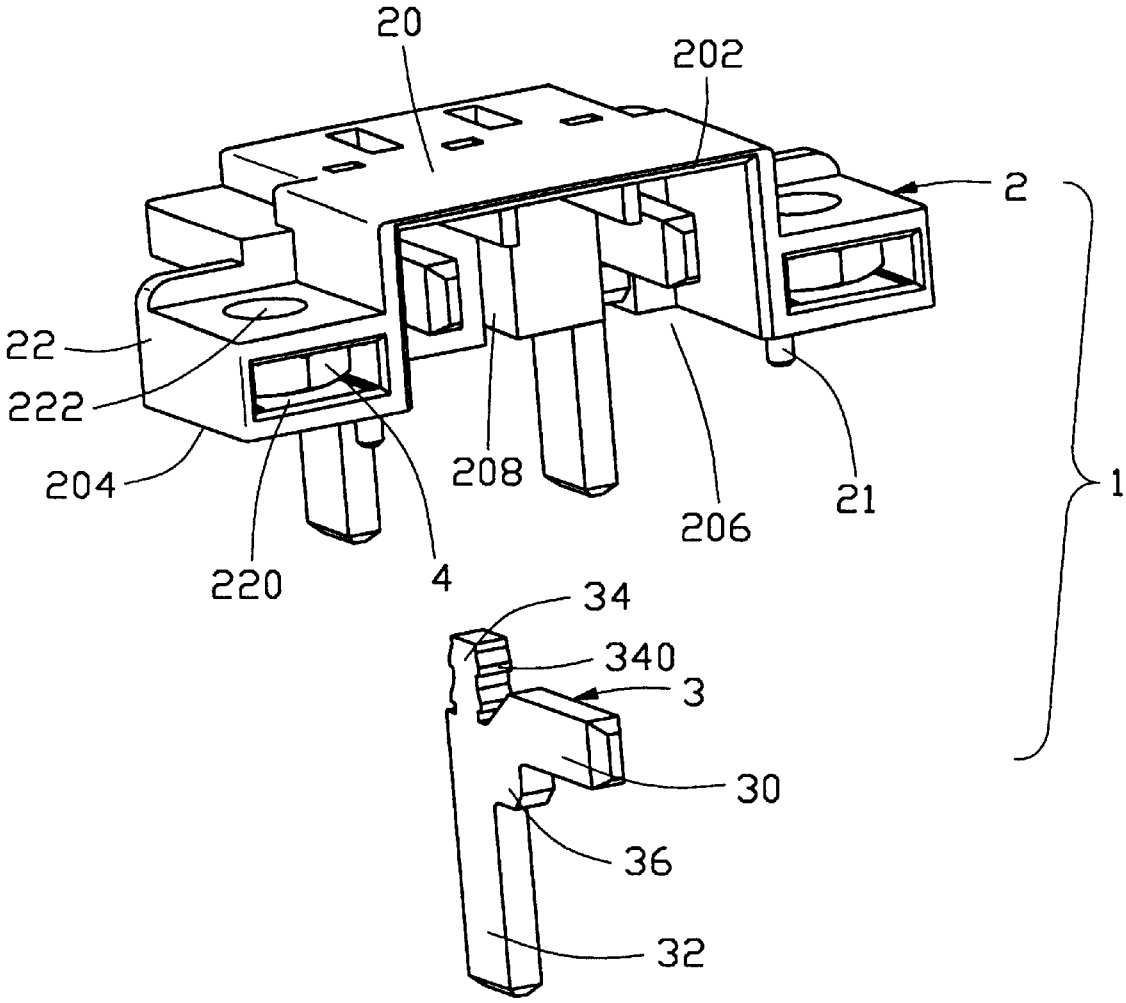
FIG. 1 is a partially exploded, perspective view of a power plug connector in accordance with the present invention.

Referring to FIG. 1, a power plug connector 1 in accordance with the present invention comprises a unitarily molded insulative housing 2 and a plurality of press-fit contacts 3 received in the housing 2.

Figure 2:
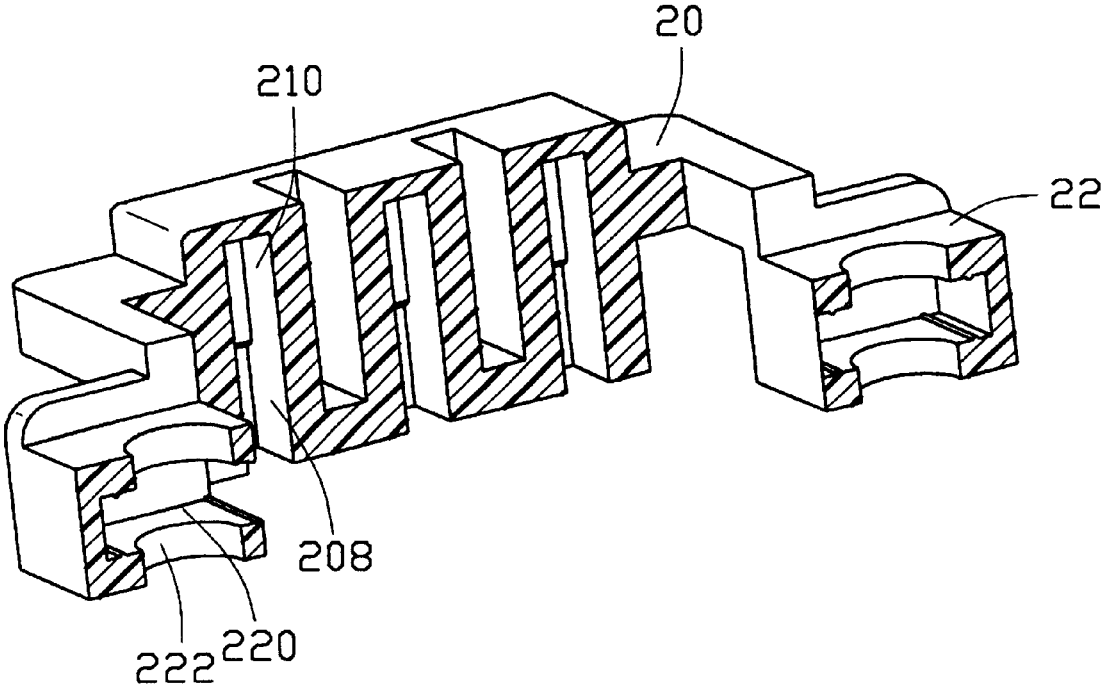
FIG. 2 is a cross-sectional, perspective view of an insulative housing of the power plug connector in FIG. 1.
Figure 3:
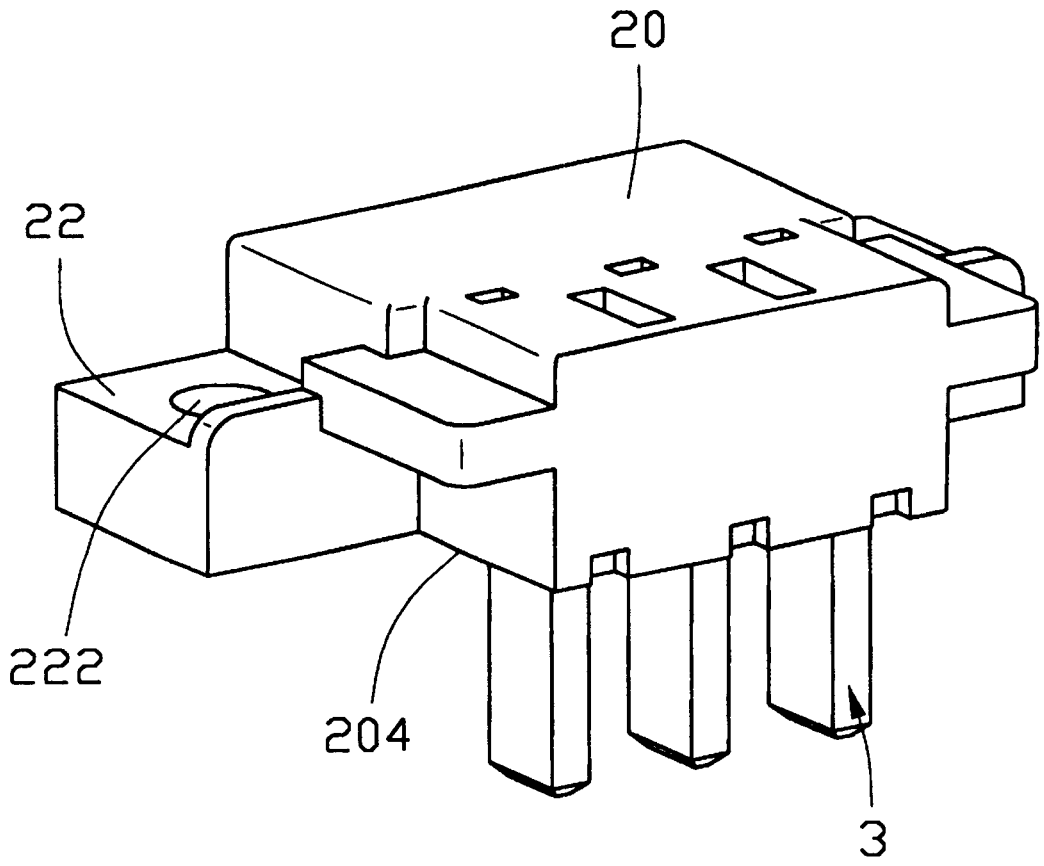
FIG. 3 is a rear, perspective view of the power plug connector in FIG. 1.

Further referring to FIGS. 2 and 3, the housing 2 comprises a body 20 and a pair of side arms 22 outwardly extending from opposite ends of the body 20 in a lengthwise direction. The housing 2 has a front mating face 202 and a bottom mounting face 204. The body 20 defines a receiving cavity 206 in the mating face 202, a plurality of passageways 208 upwardly and vertically extending from the mounting face 204 and communicating with the receiving cavity 206, and a plurality of upwardly extending recesses 210 (best shown in FIG. 6) each communicating with a corresponding passageway 208 and extending in a direction perpendicular to the mounting face 204 of the housing 2. Each side arm 22 defines a chamber 220 for receiving a nut 4 therein and a pair of vertically aligned apertures 222 communicating with the chamber 220. The diameter of the aperture 222 is larger than the largest diameter of a screw hole 40 (FIG. 5) of the nut 4. The housing 2 has a pair of positioning pins 21 extending downwardly from the mounting face 204 for positioning the power plug connector 1 relative to a printed circuit board 5 (partly shown in FIG. 6) on which the power plug connector 1 is mounted. In the preferred embodiment of the present invention, the printed circuit board 5 is a motherboard of a server.

Each press-fit contact 3 includes a mating portion 30 received in the receiving cavity 206 of the housing 2 for engaging with a complementary cable assembly (not shown) which connects with a power supply system, a mounting portion 32 extending in a direction perpendicular to the mating portion 30, a retention portion 34 upwardly extending from the mounting portion 32, and an intermediate portion 36 connecting the mating portion 30 with the mounting portion 32. The retention portion 34 has a plurality of barbs 340 thereon for retaining the contact 3 in the housing 2. The retention portion 34 has a smaller width than the mounting portion 32. The contact 3 is flat in configuration allowing for enhanced alternating current (AC) conducting capability compared with round contacts.

Figure 4:
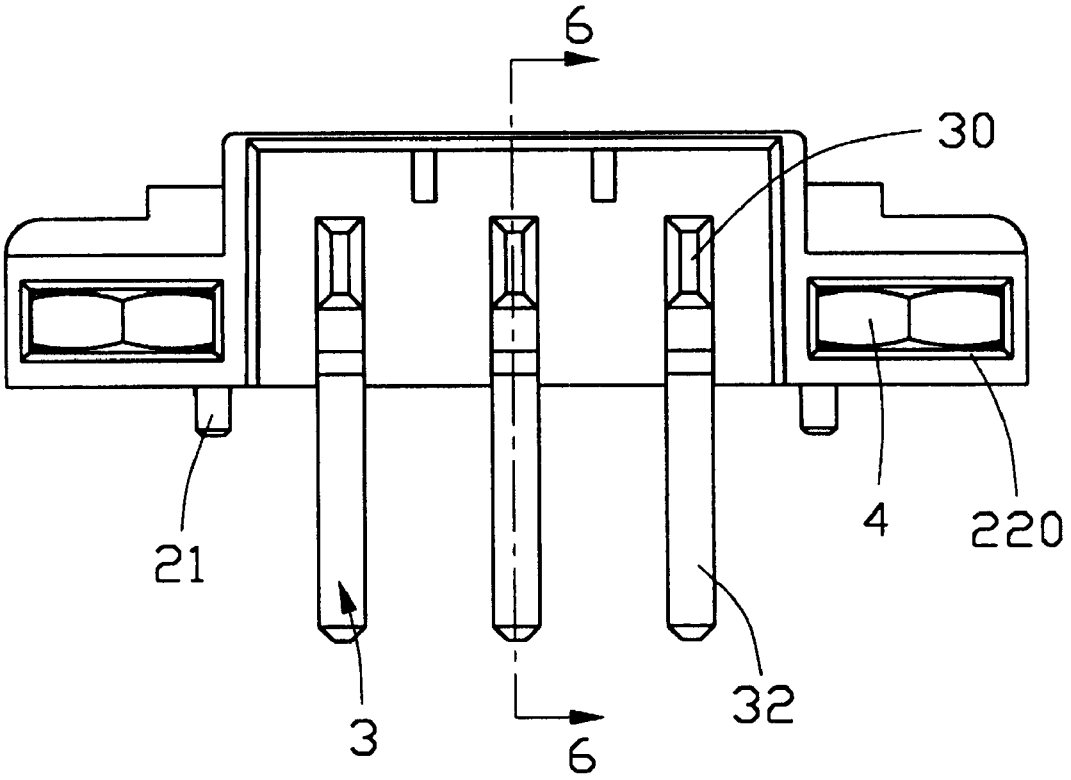
FIG. 4 is a front, plan view of the power plug connector.
Figure 5:
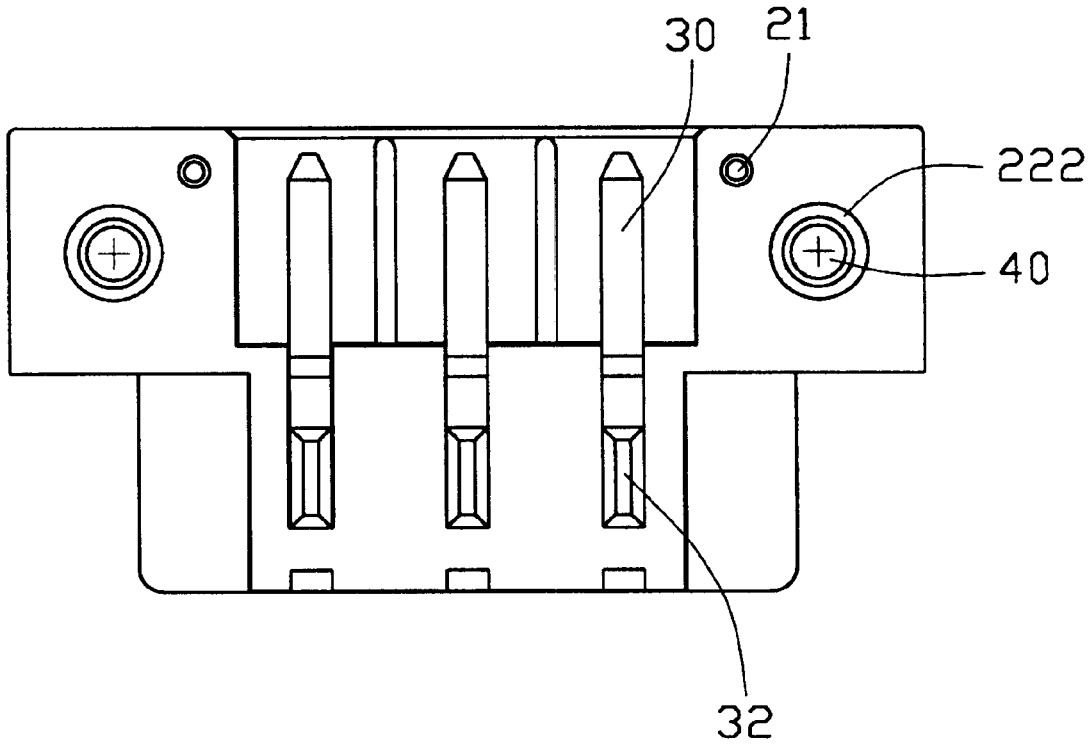
FIG. 5 is a bottom, plan view of the power plug connector.
Figure 6:
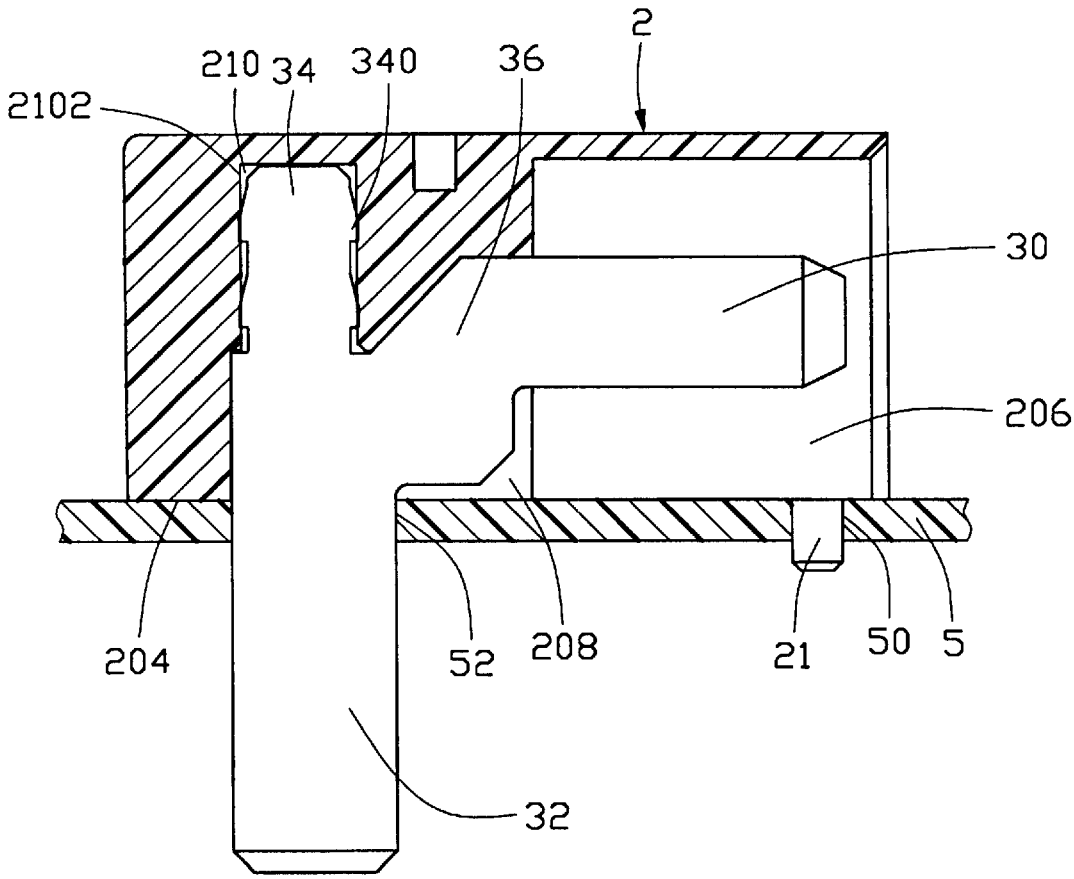
FIG. 6 is a cross-sectional view taken along section line 6—6 in FIG. 4, showing the power plug connector being mounted on a printed circuit board.
Figure 7:
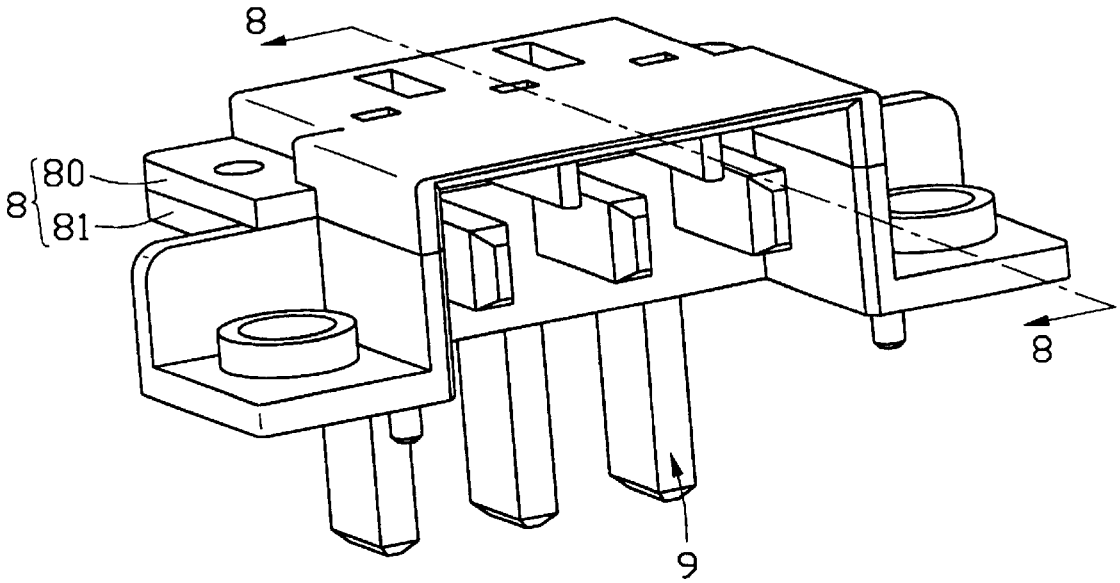
FIG. 7 (RELATED ART)
FIG. 7 is a perspective view of a related power plug connector.
Figure 8:
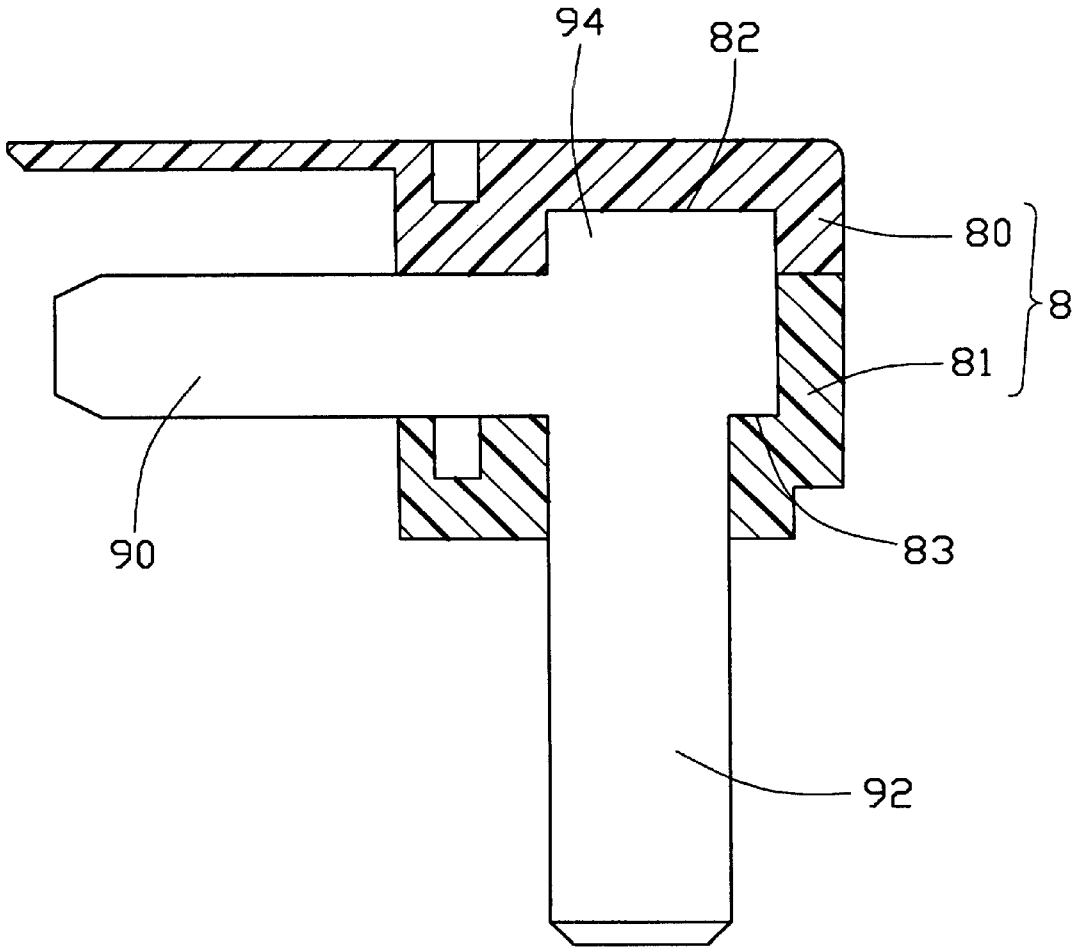
FIG. 8 (RELATED ART)
FIG. 8 is a cross-sectional view of the related power plug connector taken along section line 8—8 in FIG. 7.

Also referring to FIGS. 4–6, in assembly, the contacts 3 are assembled to the housing 2 from the bottom mounting face 204 until the retention portions 34 of the contacts 3 are received in the recesses 210. The mating portion 30 of the contact 3 extends into the receiving cavity 206 for engaging with the cable assembly. The intermediate portion 36 is received in the corresponding passageway 208. The mounting portion 32 of the contact 3 is received in the corresponding passageway 208 and partially extends beyond the mounting surface 204 of the housing 2 in a vertical direction. The barbs 340 on the retention portion 34 of each contact 3 skive into opposite sides 2102 (shown in FIG. 6) of the recess 210 for retaining the retention portion 34 in the recess 210. Thus, the contact 3 is stably secured to the housing 2, thereby ensuring a reliable electrical engagement between the power plug connector 1 and the cable assembly.

When the power plug connector 1 is mounted on the printed circuit board 5, the pair of positioning pins 21 of the housing 2 are respectively received within corresponding positioning holes 50 defined in the printed circuit board 5. The mounting portion 32 of the contact 3 is received within a corresponding through hole 52 of the printed circuit board 5 for electrically connecting with the printed circuit board 5. Also, the mounting face 204 of the housing 2 abuts against the circuit board 5 for supporting the power plug connector 1. The power plug connector 1 employs a pair of bolts (not shown) to engage with the nuts 4 received in the chambers 220 of the housing 2 and corresponding screw holes (not shown) defined in the printed circuit board 5, thereby securely mounting the power plug connector 1 on the printed circuit board 5. Furthermore, the mounting portion 32 of the contact 3 projects far beyond the printed circuit board 5 for mating with a power blade connector (not shown) mounted on a daughter board (not shown) of the server, whereby an electrical connection is established between the mother board and the daughter board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power plug connector for being mounted on a printed circuit board, comprising:

an insulative housing defining a receiving cavity in a mating face thereof, a plurality of passageways upwardly extending from a mounting face thereof, and a plurality of upwardly extending recesses each communicating with a corresponding passageway; and a plurality of contacts inserted into the housing from the mounting face, each contact including a mating portion extending into the receiving cavity, a mounting portion extending in a direction perpendicular to the mating portion and received in a corresponding passageway, an intermediate portion connecting the mating portion with the mounting portion, and a retention portion upwardly extending from the mounting portion and received in a corresponding recess, the retention portion having a plurality of barbs thereon for retaining the contact in the housing;

wherein the intermediate portion is received in a corresponding passageway and is downwardly exposed;

wherein the mounting portion of the contact projects beyond the mounting face of the housing in a vertical direction adapted for connection with the printed circuit board;

wherein the housing has a pair of positioning pins extending downwardly from the mounting face thereof adapted for being received in corresponding positioning holes of the printed circuit board;

wherein the housing comprises a pair of side arms, each side arm defining a chamber for receiving a nut therein and a pair of vertically aligned apertures each in communication with the chamber;

wherein the retention portion of the contact has a smaller width than the mounting portion.

* * * * *